United States Patent [19]

McNiel

[11] Patent Number: 4,906,210

[45] Date of Patent: Mar. 6, 1990

[54] ELECTRICAL CONNECTOR WITH IMPROVED CONTACT

[75] Inventor: Richard A. McNiel, Temple City, Calif.

[73] Assignee: IMO Delaval Incorporated, Lawrenceville, N.J.

[21] Appl. No.: 232,179

[22] Filed: Aug. 15, 1988

[51] Int. Cl.[4] ..... H01R 4/48

[52] U.S. Cl. ..... 439/839; 439/843; 439/863; 439/385

[58] Field of Search ..... 439/299, 300, 324, 349, 439/369, 370, 805, 819, 820, 840, 841, 843, 848, 851–858, 180, 382, 839, 863, 385

[56] References Cited

U.S. PATENT DOCUMENTS

| | | | |
|---|---|---|---|
| 2,014,056 | 9/1935 | Van Noorden | 439/820 |
| 3,613,046 | 10/1971 | Kirk | 439/369 |
| 4,204,738 | 5/1980 | Tillotson | 439/369 |
| 4,773,874 | 9/1988 | Kopeski, Jr. | 439/369 |
| 4,775,335 | 10/1988 | Havel | 439/820 |

FOREIGN PATENT DOCUMENTS

| | | | |
|---|---|---|---|
| 1275314 | 8/1968 | Fed. Rep. of Germany | 439/841 |
| 397452 | 5/1909 | France | 439/840 |
| 487196 | 6/1918 | France | 439/841 |
| 388894 | 3/1933 | United Kingdom | 439/841 |

*Primary Examiner*—David Pirlot

*Attorney, Agent, or Firm*—Benoit Law Corporation

[57] ABSTRACT

An electrical connector comprises a plug having an elongate prong releasably received in a hollow receptacle and retained for electrical contact by a retainer. An improvement of that electrical contact is achieved by tensioning the prong in the receptacle against the retainer. A spring may be tensioned for that purpose in the receptacle between that receptacle and the prong.

20 Claims, 1 Drawing Sheet

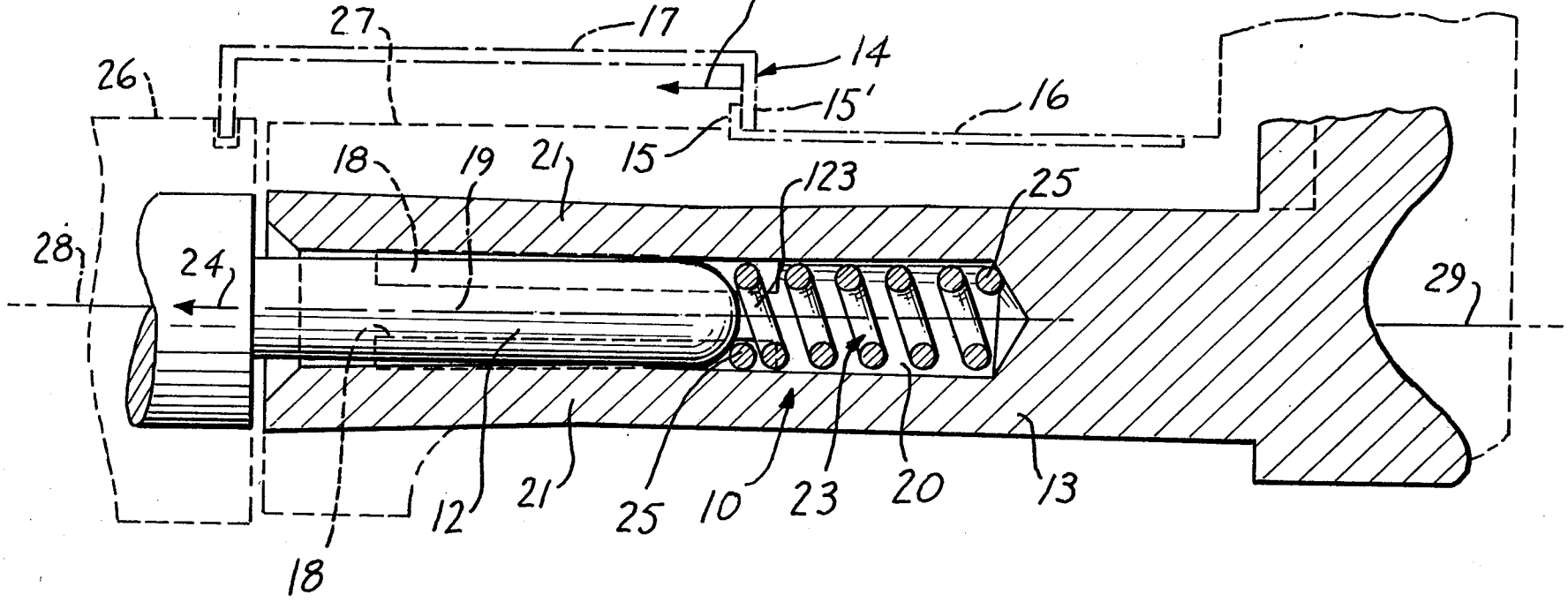
29
16
25
13
20
14
15'
123
124
23
10
17
15
25
21
21
19
12
27
18
18
24
26
28

ELECTRICAL CONNECTOR WITH IMPROVED CONTACT

BACKGROUND OF THE INVENTION

The subject invention relates to electrical connectors and, more specifically, to means and methods for improving electrical contact in such connectors.

Even though systematic development of electrical connectors has been going on for a couple of hundred years, there still are unsatisfied pressing needs in that area. Especially hostile environments have caused many heretofore unsolved problems.

To name but one example, with the cost of drilling and petroleum production getting higher every month, it is important to the potential developer to accurately evaluate the capacity of the well throughout its production life. Electrical transducers play a vital role in this process. For instance, miniature pressure transducers are now able to measure minute changes in pressure in a well where operating pressures range from 1,000 psi to 20,000 psi. Environments for that kind of application are especially hostile, including continuous operating temperatures between 300° and 350° F., with peaks as high as 700° F. In addition, the transducer must be able to withstand the shocks and vibrations of drilling sites and offshore platforms.

Of course, such hostile environment, with high pressures, temperatures, shock loads and vibrations, affects not only the transducer, but also the electrical connector with which the transducer is connected to energizing and measurement circuitry. The best transducer is of no use, if its connector is not capable of conducting the minute transducer signals without impairment to the measurement circuitry.

In this respect, there have been frequent connector failures, even where connectors with a threaded retainer between plug and receptacle were employed. The failure rate was particularly high in the above mentioned environment, but the utility of the subject invention extends, of course, to other environments and applications where contact problems are encountered.

SUMMARY OF THE INVENTION

It is an object of this invention to overcome the problems and meet the needs expressed above or otherwise implicit herein.

From a first aspect thereof, the subject invention resides in an electrical connector comprising, in combination, a plug having an electrically conducting elongate prong, a receptacle having an electrically conducting hollow portion for receiving the prong for electrical contact of a conductor connected to the prong with a conductor connected to the hollow portion, means for releasably retaining the prong in the above mentioned hollow portion, including a retainer coupled to the plug and to the receptacle externally of the plug and the receptacle and spaced from the prong, and means for tensioning said retainer coupled to the plug and to the receptacle, including a spring tensioned in the above mentioned hollow portion against the prong.

From another aspect thereof, the subject invention resides in an electrical connector wherein an elongate prong releasably received in a hollow receptacle is retained for electrical contact. The invention according to this aspect resides in the improvement comprising in combination, a retainer spaced from the prong and from the receptacle for releasably retaining the prong in the receptacle a spring positioned in that receptacle to tension the retainer via the prong for improved electrical contact.

The subject invention also resides in a method of providing electrical connection via a hollow receptacle and an elongate prong releasably received in that hollow receptacle and retained for electrical contact by a retainer. The invention according to this aspect resides in the method of improving the electrical contact by locating the retainer at all times spaced from that hollow receptacle and from the prong and by tensioning the retainer via the prong in the receptacle.

BRIEF DESCRIPTION OF THE DRAWINGS

The subject invention and its various aspects and objects will become more readily apparent from the following detailed description of preferred embodiments thereof, illustrated by way of example in the accompanying drawing which is a longitudinal section through a connector according to a preferred embodiment of the subject invention, and a diagrammatic showing of related parts.

DESCRIPTION OF PREFERRED EMBODIMENTS

The electrical connector 10 shown in FIG. 1 is of a type wherein an elongate prong 12 releasably received in a hollow receptacle 13 is retained for electrical contact by a retainer 14. Since various types of retainers are suitable, the retainer 14 has been shown in FIG. 1 by phantom lines.

By way of example, one suitable form of retainer is the familiar type in which an internally threaded cap is applied to a mating externally threaded member after the male and female connector parts have been coupled together. In practice, the externally threaded receiver may be mechanically connected to either of the corresponding connector parts, while the internally threaded cap may be coupled to the other one of these two parts, as has been customary for many years. When the two parts are coupled together, the cap is threaded onto the receiver and is tightened thereon, so that the prong is firmly retained in the hollow receptacle. This is shown in FIG. 1 by illustrating an overlap 15 and 15' of the receiver 16 and cap 17 parts. In practice, 15 and 15' may, for instance, represent external and internal threads, respectively.

Under the above mentioned or other adverse or severe environmental conditions, even an excellent retainer has not been able to maintain electrical contact consistently. Rather, the electric signals that were supposed to be conducted through the connector either were degraded or became interrupted in the connector altogether, even when the retainer 14 was firmly in place.

In an effort to solve the problem, elongate slots 18 were cut into the receptacle around the hollow portion thereof, and in parallel to the longitudinal axis 19 of the prong 12 and receptacle 13 or axial cavity 20 therein. This left longitudinal strips 21 in parallel to the receptacle axis 19. The receptacle 13 was made of resilient electrically conducting material and the strips 21 were bent inwardly, so as to be in intimate contact with a substantial lateral portion of the prong 12 upon insertion thereof into the receptacle cavity 20.

However, even that, in conjunction with the retainer 14, was not sufficient to avoid contact and electrical signal conduction problems in adverse or severe environments.

According to a preferred aspect of the subject invention, the contact problem is solved by tensioning the retainer 14 via the prong 12 in the receptacle.

In the illustrated preferred embodiment of the invention, the major improvement comprises the spring 23 positioned in the receptacle 13 to tension the retainer 14 via the prong 12 for improved electrical contact.

The receptacle 13 has an elongate cavity for receiving the prong 12, and the spring 23 is located in an extension of that cavity 20. The spring has a front portion 123 in the path of the prong 12 in the hollow receptacle 13. Accordingly, the spring 23 is compressed by the prong 12 being inserted into the receptacle 13.

The spring 23 thus biases the prong 12 in a direction 24 out of the receptacle 13. More generally, the prong is tensioned in the receptacle by biasing that prong in a direction 24 out of that receptacle. In the illustrated preferred embodiment of the invention, that tensioning is effected with the spring 23 in the receptacle 13.

The biasing in direction 24 is countered by the retainer 14. For instance, as indicated by the arrow 124, that biasing, originated by the spring 23, tensions the corresponding parts 15 and 15' of the retainer 14 into engagement with each other.

The hollow portion of the receptacle has an inwardly bent region at 21 for intimate contact with the prong. In other words, the receptacle 13 is tensioned into lateral engagement with the prong 12. Simiarly, the spring 23 may be retained in the receptacle by tensioning portions 21 of that receptacle inwardly for engagement by the prong 12, or into lateral engagement with that prong. By way of example, crimping may be employed for that purpose. The spring is held or retained inside the elongate cavity 20 by a friction fit or interference fit through the crimped portion, and may have its own retension members, such as in the form of laterally projecting or rough end tabs 25 at either or both ends. In this respect, a spring end or end tab 25 may project into one of the slots 18.

Generally speaking, the spring 23 thus is retained in the receptacle 13 by tensioning portions 21 of the receptacle inwardly for engagement by the prong 12.

The spring 23 encompasses a longitudinal axis 19 of the hollow portion or receptacle 13. In accordance with a preferred embodiment of the invention, the prong 12, hollow portion or receptacle 13, and the spring 23 have a common longitudinal axis 19.

According to the illustrated preferred embodiment of the invention, the spring 23 is a spiral or helical spring. However, other spring configurations may be employed within the scope of the subject invention.

The same applies to the remainder of the electrical connector, including plug and receptacle which, therefore, are shown only schematically in dotted outline.

In particular, the illustrated connector 10 also comprises a plug 26 having one or more electrically conducting elongate prongs 12, and a receptacle body 27 having one or more electrically conducting hollow portions or receptacles 13 for receiving the prong or prongs for electrical contact of one or more conductors 28 connected to the prong or prongs with one or more conductors 29 connected to the hollow portions or receptacles 13.

The previously described retainer 14 may be coupled to the plug 26 and to the receptacle body 27, especially as to mating portions 15' and 15, or parts 17 and 15, respectively, for releasably retaining the prong 12 in the hollow part or retainer 13.

As already indicated above, the means for tensioning the retainer means 14 coupled to the plug 26 and receptacle 27, include a spring 23 tensioned in the hollow part or receptacle 13 between that part or receptacle and the prong 12.

Electrical connectors pursuant to the illustrated embodiment of the invention have performed well in vibratory and adverse environments of the above mentioned type, and have conducted delicate electrical signals at temperatures up to 700° F.

Retainment is also provided by the crimped or inwardly bent flexible portions 21 of the receptacle providing intimate contact with a substantial lateral portion of the prong 12. Within the scope of the subject invention, electrical contact is improved by tensioning that retainment via the prong 12 in the receptacle 13, such as with the spring 23 shown in the illustrated preferred embodiment. Accordingly, at least part of the retainment is provided by tensioning the receptacle into lateral engagement with the prong 12, and such retainment is tensioned by biasing the prong 12 in a direction 24 out of the receptacle 13.

Within the broad scope of the invention, a retainment may be achieved by longitudinally splitting the prong 12 so that that prong is radially biased into lateral engagement with the hollow part or receptacle 13, while being longitudinally biased in the direction 24, such as by the spring 23.

Various other modifications and variations within the spirit and scope of the subject invention and equivalents thereof will become apparent to those skilled in the art from the subject extensive disclosure.

I claim:

1. An electrical connector comprising in combination:

a plug having an electrically conducting elongate prong;

a receptacle having an electrically conducting hollow portion for receiving said prong for electrical contact of a conductor connected to said prong with a conductor connected to said hollow portion;

means for releasably retaining said prong in said hollow portion, including a retainer coupled to said plug and to said receptacle externally of said plug and said receptacle and spaced from said prong; and means for tensioning said retainer coupled to said plug and to said receptacle, including a spring tensioned in said hollow portion against said prong.

2. An electrical connector as claimed in claim 1, wherein:

said retainer includes a first part mechanically connected to the receptacle and a second part mechanically connected to the plug and releasably coupled to said first part; and said means for tensioning said retainer include said spring for tensioning said first and second parts into engagement with each other.

3. An electrical connector as claimed in claim 1, wherein:

said spring is a helical spring.

4. An electrical connector as claimed in claim 3, wherein:

said helical spring is in said hollow portion.

5. An electrical connector as claimed in claim 3, wherein:

said helical spring has a portion in a path of said prong in said hollow portion.

6. An electrical connector as claimed in claim 3, wherein:

said helical spring encompasses a longitudinal axis of said hollow portion.

7. An electrical connector as claimed in claim 3, wherein:

said prong, said hollow portion and said helical spring have a common longitudinal axis.

8. An electrical connector as claimed in claim 1, wherein:

said hollow portion has an elongate cavity for receiving said prong; and said spring is in an extension of said cavity.

9. An electrical connector as claimed in claim 8, said hollow portion has an inwardly bent region for intimate contact with said prong.

10. In an electrical connector wherein an elongate prong releasably received in a hollow receptacle is retained for electrical contact, the improvement comprising, in combination:

a retainer spaced from said prong and from said receptacle for releasably retaining said prong in said receptacle;

a spring positioned in said receptacle to tension said retainer via said prong for improved electrical contact.

11. An electrical connector as claimed in claim 10, wherein:

said receptacle has an elongate cavity for receiving said prong; and said spring is in an extension of said cavity.

12. An electrical connector as claimed in claim 10, wherein:

said spring encompasses a longitudinal axis of an elongate prong-receiving cavity in said receptable.

13. An electrical connector as claimed in claim 10, wherein:

said prong, said hollow cavity and said spring have a common longitudinal axis.

14. An electrical connector as claimed in claim 10, wherein:

said spring has a portion in a path of said prong in said hollow receptacle.

15. An electrical connector as claimed in claim 10, wherein:

said hollow receptacle has an inwardly bent region for intimate contact with said prong.

16. An electrical connector as claimed in claim 10, wherein:

said spring is a helical spring in said hollow receptacle.

17. In a method of providing electrical connection via a hollow receptacle and an elongate prong releasably received in said hollow receptacle and retained for electrical contact by a retainer, the method of improving said electrical contact by locating said retainer at all times spaced from said hollow receptacle and from said prong and by tensioning said retainer via said prong in said receptacle.

18. A method as claimed in claim 17, wherein:

said prong is tensioned in said receptacle by biasing said prong in a direction out of said receptacle.

19. A method as claimed in claim 17, wherein:

said tensioning is effected with a spring in said receptacle.

20. A method as claimed in claim 19, wherein:

said spring is retained in said receptacle by tensioning portions of said receptacle inwardly for engagement by said prong.

* * * * *